US009252546B2

(12) United States Patent
Busse et al.

(10) Patent No.: US 9,252,546 B2
(45) Date of Patent: Feb. 2, 2016

(54) DISTRIBUTOR CONNECTION MODULE

(75) Inventors: Ralf-Dieter Busse, Hoppegarten (DE); Heiko Neumetzler, Berlin (DE); Joachim Stark, Berlin (DE); Philipp Meyer, Berlin (DE); Antony Nijhuis, Modautal-Brandau (DE)

(73) Assignee: CommScope Technologies LLC, Hickory, NC (US)

( * ) Notice: Subject to any disclaimer, the term of this patent is extended or adjusted under 35 U.S.C. 154(b) by 85 days.

(21) Appl. No.: 14/116,678

(22) PCT Filed: Dec. 2, 2011

(86) PCT No.: PCT/EP2011/006035

§ 371 (c)(1),
(2), (4) Date: Nov. 8, 2013

(87) PCT Pub. No.: WO2012/152300

PCT Pub. Date: Nov. 15, 2012

(65) Prior Publication Data

US 2014/0073199 A1 Mar. 13, 2014

(30) Foreign Application Priority Data

May 11, 2011 (DE) ..... 10 2011 101 201

(51) Int. Cl.
*H01R 4/24* (2006.01)
*H01R 24/22* (2011.01)
*H01R 13/66* (2006.01)

(52) U.S. Cl.
CPC ..... *H01R 24/22* (2013.01); *H01R 13/6666* (2013.01); *H01R 2201/16* (2013.01)

(58) Field of Classification Search
CPC ... H01R 4/2429; H01R 13/6666; H01R 9/031
See application file for complete search history.

(56) References Cited

U.S. PATENT DOCUMENTS 4,616,288 A 10/1986 Scholtholt et al.
5,086,368 A 2/1992 Gerke et al.

(Continued)

FOREIGN PATENT DOCUMENTS

DE 3 311 488 10/1984
DE 39 17 270 11/1990

(Continued)

OTHER PUBLICATIONS

International Search Report for International Application No. PCT/EP2011/006035 mailed Jun. 6, 2012 (6 pages).

*Primary Examiner* — Xuong Chung Trans
(74) *Attorney, Agent, or Firm* — Merchant & Gould P.C.

(57) ABSTRACT

The invention relates to a distribution connection module (1) for telecommunications and data technology, with the distribution connection module (1) comprising a first submodule (2) and a second submodule (3), with the first and second submodule (2, 3) each having contact elements (7, 13), with the contact elements (7, 13) each having an electrical connecting contact (8, 14) and an interface contact (9, 15), with the interface contacts (9) of the first submodule (2) being electrically connected to one another by the interface contacts (15) of the second submodule (3), or with the interface contacts (9) of the first submodule (2) being connected to interface contacts (61) of a further submodule (60) and the interface contacts (15) of the second submodule (3) being connected to interface contacts (62) of a further submodule (60), with the further submodules (60) being arranged between the first and the second submodules (2, 3).

20 Claims, 13 Drawing Sheets

(56) References Cited

U.S. PATENT DOCUMENTS

| | | | | |
|---|---|---|---|---|
| 5,147,218 | A | 9/1992 | Matthews et al. | |
| 5,178,558 | A | 1/1993 | Knox et al. | |
| 5,281,163 | A | 1/1994 | Knox | |
| 5,575,689 | A | 11/1996 | Baggett et al. | |
| 5,800,215 | A * | 9/1998 | Dohnke et al. | 439/719 |
| 6,514,094 | B1 | 2/2003 | Reichle | |
| 7,270,551 | B2 * | 9/2007 | Busse et al. | 439/76.1 |
| 7,503,798 | B2 | 3/2009 | Hashim | |
| 7,632,133 | B2 | 12/2009 | Wu | |
| 7,828,584 | B2 | 11/2010 | Neumetzler | |
| 2006/0160404 | A1 | 7/2006 | Alarcon | |
| 2007/0285879 | A1 | 12/2007 | Busse et al. | |
| 2012/0135644 | A1 | 5/2012 | Muller | |

FOREIGN PATENT DOCUMENTS

| | | |
|---|---|---|
| DE | 100 29 649 | 1/2002 |
| DE | 10 2007 026 097 | 12/2008 |
| DE | 11 2007 000 535 | 1/2009 |
| EP | 0 073 740 | 3/1983 |
| WO | WO 00/04607 | 1/2000 |
| WO | WO 2010/142359 | 12/2010 |

* cited by examiner 1
2
3
4
5
6
S1
S2
D1
d1
D2
d2
d3
d4

A (FIG.14)
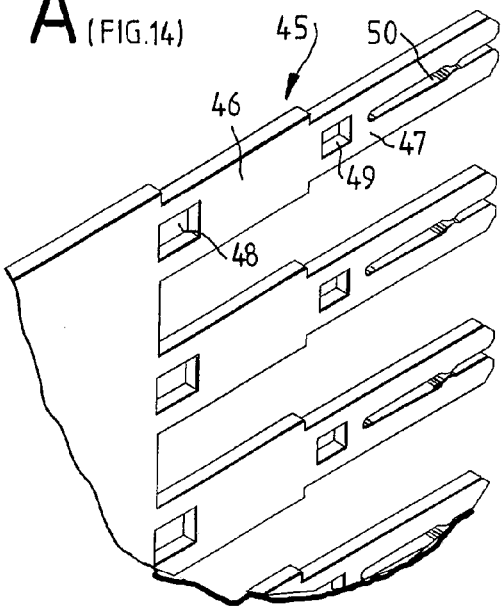
B (FIG.15)
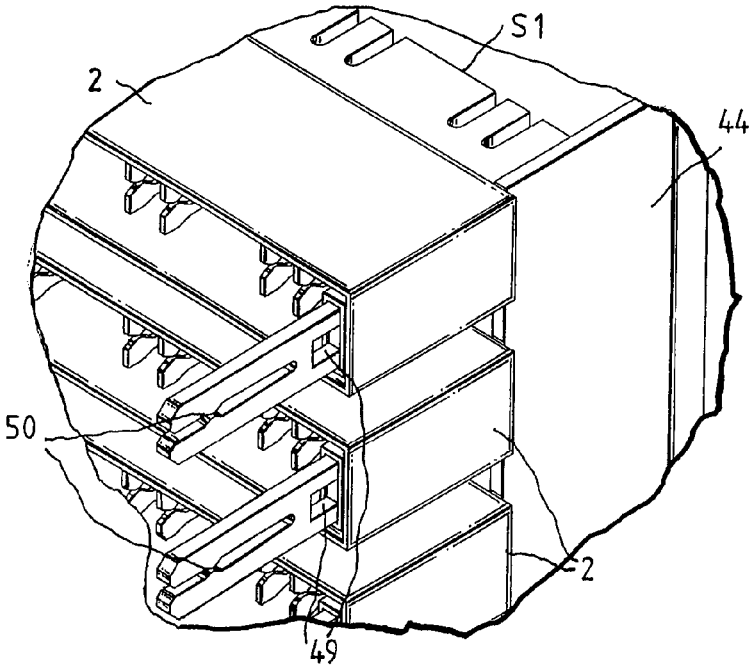

DISTRIBUTOR CONNECTION MODULE

This application is a National Stage Application of PCT/EP2011/006035, filed 2 Dec. 2011, which claims benefit of Serial No. 10 2011 101 201.3, filed 11 May 2011 in Germany and which applications are incorporated herein by reference. To the extent appropriate, a claim of priority is made to each of the above disclosed applications.

The invention relates to a distribution connection module for telecommunications and data technology.

DE 100 29 649 A1 discloses a distribution connection module comprising a housing in which externally accessible input and output contacts are arranged for connection of lines or conductors, with the housing having a cavity in which function elements are arranged between the input and output contacts. The function elements are in this case arranged on at least one printed circuit board, which is supported in the housing. The input and output contacts are in this case, by way of example, conductor connecting contacts in the form of insulation-displacement terminal contacts, with the input and output contacts preferably being arranged on opposite end faces of the housing. It is also proposed that a disconnecting contact, which is externally accessible, in each case be arranged between an input and an output contact.

The invention is based on the technical problem of providing a distribution connection module which allows easier and more flexible use, and of providing a method for connection of a distribution connection module such as this.

For this purpose, the distribution connection module for telecommunications and data technology comprises a first submodule and a second submodule, with the submodules each having contact elements, with the contact elements each having a connecting contact and an interface contact, with the interface contacts of the first submodule being electrically connected to one another by means of the interface contacts of the second submodule, preferably with a mechanical connection being made as well. This allows the distribution connection module to be assembled in the form of building blocks, as long as only the interface contacts of the first and second submodules are matched to one another. The connecting contacts of the first and/or second submodules may in contrast be adapted, depending on the application. In this case, for example, the first submodule may, however, also in each case be the same, with the matching being carried out exclusively via the second submodule. The electrical connecting contacts are preferably conductor connecting contacts such as insulation-displacement terminal contacts, wire-wrap contacts, fork contacts or plug connectors, such as RJ plug connectors or coaxial plugs. The electrical connecting contacts may, however, also be tapping contacts, contact tongues or pins, which, for example, can be soldered.

In one alternative embodiment, the distribution connection module comprises at least one further submodule. The further submodule or submodules is or are in this case arranged between the first and the second submodules, with the interface contacts of the first submodule being connected to interface contacts of a further submodule, and the interface contacts of the second submodule being connected to interface contacts of a further submodule. In this case, only one further submodule is preferably arranged between the first and the second submodules, and this may also be referred to as a third submodule. In this case, the third submodule has interface contacts for the first submodule, and interface contacts for the second submodule. If the intention is to provide the capability for the first and second submodules to be used both on their own and with a third submodule, then the interfaces of the third submodule for connection to the first submodule are designed in the same or a similar manner as the interface contacts of the second submodule. Correspondingly, the interfaces of the third submodule for connection to the second submodule are designed in the same or a similar manner as the interface contacts of the first submodule. In this case, it is likewise possible for the third submodule to have contact elements with interface contacts which are used for connection to the first and/or second submodule. However, embodiments are possible where a third submodule is always provided. In this case, the interface contacts of the first and second submodules need not be matched to one another. It is self-evident that the statements relating to the third submodule also apply to embodiments having a plurality of further submodules, in which case the plurality of submodules between the first and second submodules can then be considered figuratively to be combined in the form of a third submodule. The third submodule may, for example, have electrical components which, for example, are arranged on printed circuit boards. The electronic components are in this case preferably passive electronic components, which means that there is no need to provide separate supply voltage connections or rechargeable batteries. The configuration or upgrading can then be carried out very easily by replacement of the third submodules. In this case, the length of a housing of the third submodule may be dependent on the type of electronics accommodated. All this also allows flexible retrospective conversion or extension of a telecommunications infrastructure. The first and/or the second and/or the third submodule may have means for attachment to a mount system. For example, it is possible for the first submodules to be mounted on the mount system, in which case the second submodules and, possibly before this, the third submodules are then connected as required to the first submodules. For example, the mount system is a trough or a round rod mount system. The connecting contacts are preferably arranged such that, once the distribution connection module has been assembled, the connecting contacts of the first submodule and of the second submodule are accessible from mutually opposite end faces of the distribution module.

In one embodiment, the first submodule and/or the second submodule have/has a housing, in which case both submodules preferably have a housing. In this case, the housing may be formed from one or more parts. However, embodiments are also conceivable where only one submodule consists, for example, of a printed circuit board, on which the connecting contacts are soldered and the interface contacts are free, in such a way that they can be connected to the interface contacts of the other submodule.

In a further embodiment, the contact elements of the first submodule and/or of the second submodule are arranged in a captive manner. In this case, captive means that the contact elements can absorb the insertion, withdrawal and connection forces which occur. This makes it possible to prefabricate the first and/or the second submodule with cables. In this case, it is also possible to share one cable between a plurality of first and/or second submodules. Particularly when the connecting contacts are in the form of insulation-displacement terminal contacts or wire-wrap contacts, this prefabrication results in considerable assembly time savings.

In a further embodiment, the interface contacts of the first and second submodule are in the form of fork contacts or contact tongues.

For example, the interface contacts of the contact elements in the first submodule are in the form of fork contacts, and the interface contacts of the contact elements in the second submodule are in the form of contact tongues. The advantage of fork contacts is that they ensure good tolerance compensation, with an adequate contact force, with the contact force furthermore being symmetrical. In this case, conversely, it is also possible for the contact elements on the first submodule to be contact tongues, and for those on the second submodule to be fork contacts. It is also possible for the interface contacts in each submodule each to be alternately fork contacts and contact tongues. Finally, both the interface contacts in the first submodule and those in the second submodule may be fork contacts.

In a further embodiment, the interface contacts of the contact elements in the first submodule and/or the interface contacts of the contact elements in the second submodule are in the form of sprung contact arms, with one interface contact of the contact elements in the first and the second submodules in each case forming a disconnecting contact.

In a further embodiment, the contact elements in the first submodule and/or the contact elements in the second submodule have a function contact which is located between the interface contact and the connecting contact, with at least one electrical function element being connected to the function contact. It is preferable for the function contact to be in the second submodule, since defective function elements can then be replaced more easily, and other function elements can then be connected in line.

In a further embodiment, the contact elements in the second submodule have the function contacts, with the function contacts having rectangular contact strips to which the function elements are connected.

In a further embodiment, the function contacts are U-shaped, with a base of the U-shaped contact forming the contact strip, and with limbs of the U-shaped contact forming connecting webs for the connecting contact and the interface contact of the contact element.

Preferably, the function contacts of a contact element pair are aligned with the limbs with respect to one another, such that a rectangular area, in which the function element or elements is or are arranged, is formed between the function contacts.

Preferably, the function elements are in the form of surge arresters, and they are furthermore preferably in the form of three-pole surge arresters. The surge arresters are preferably cylindrical, in which case they can be arranged such that their longitudinal axis is parallel to or at right angles to the longitudinal axis of the contact elements.

In a further embodiment, the ground connections of surge arresters are connected to a common ground. The common ground preferably makes contact with center electrodes of the surge arresters, preferably by welding, soldering, adhesive bonding or clamping. Furthermore preferably, the surge arresters have fail-safe contacts. The fail-safe contacts close the electrodes if an overvoltage occurs, and thus closes the respective line, which is connected to the electrodes, to ground. For this purpose, a solder pellet or a melting foil is arranged under the fail-safe contact. The common ground is preferably formed by ground contacts, which make contact with the mount system.

In a further embodiment, the contact elements of the second submodule each have a further connecting contact. This further connecting contact may be in the form of a contact tongue or a conductor connecting contact. This further connecting contact allows measurements to be carried out in line, or else also makes it possible to ensure switching to the jumper side without any interruption.

A distribution module is preferably connected by first of all connecting the connecting contacts in the first submodule. In this case, by way of example, the first submodule can be connected in a prefabricated manner, or may be connected in situ. When connected in situ, the first submodule is preferably moved to the mount system rotated through 180°, such that the conductor connecting contacts face forward. The first submodule is then connected to conductors, is removed from the mount system and is once again rotated through 180°. The at least one first submodule is then attached to a mount system, after which the second submodule is connected to the first submodule. This can be done by attachment to the first submodule and/or attachment to the mount system. In embodiments having a third submodule, this can first of all be attached with the first submodule, with the second submodule then being connected to the third submodule. In this case, the third submodule can be attached with the first submodule before the attachment of the first submodule with the mount system, or thereafter. It is likewise conceivable for the second and third submodules to be connected before the third submodule is then connected to the first submodule.

The invention will be explained in more detail in the following text with reference to one preferred exemplary embodiment. In the figures.

Figure 8:
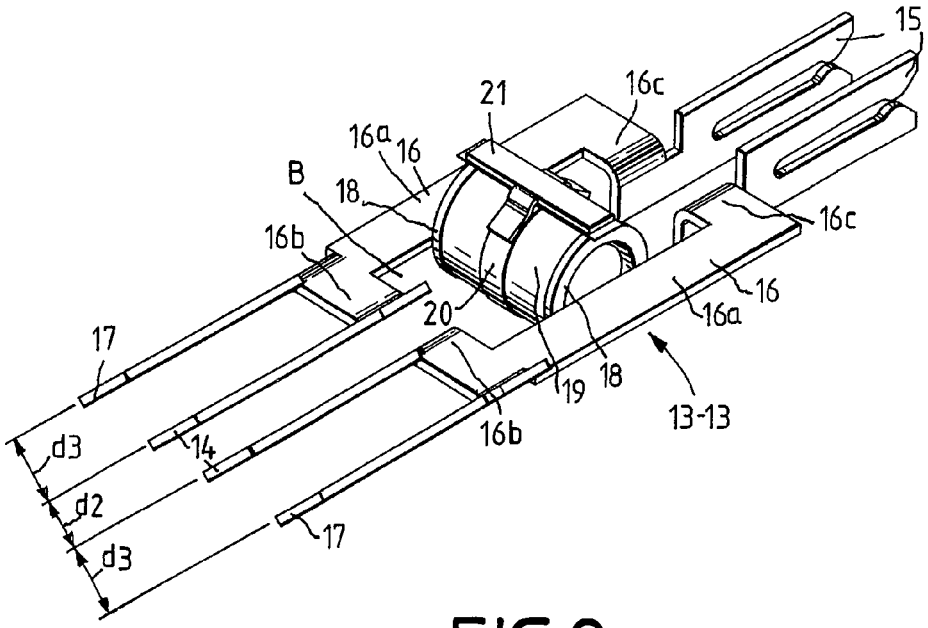
Figure 9:
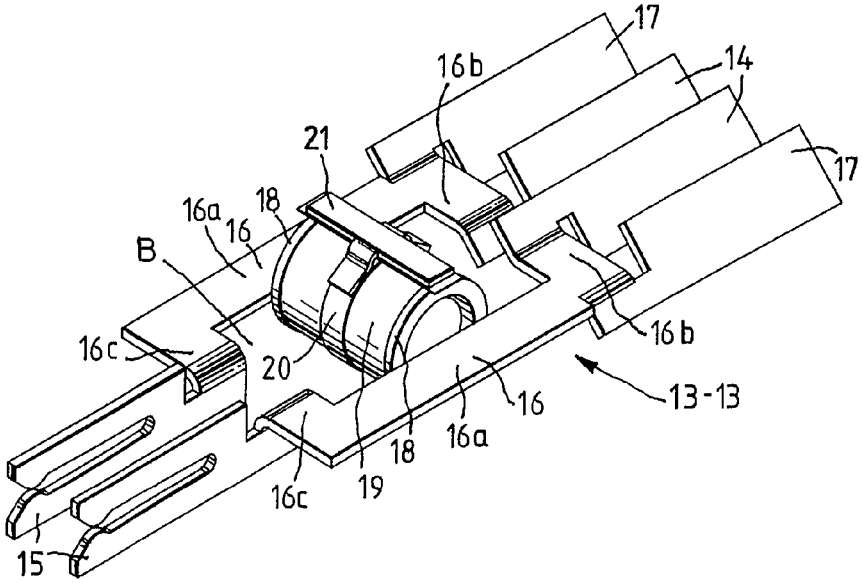
Figure 10:
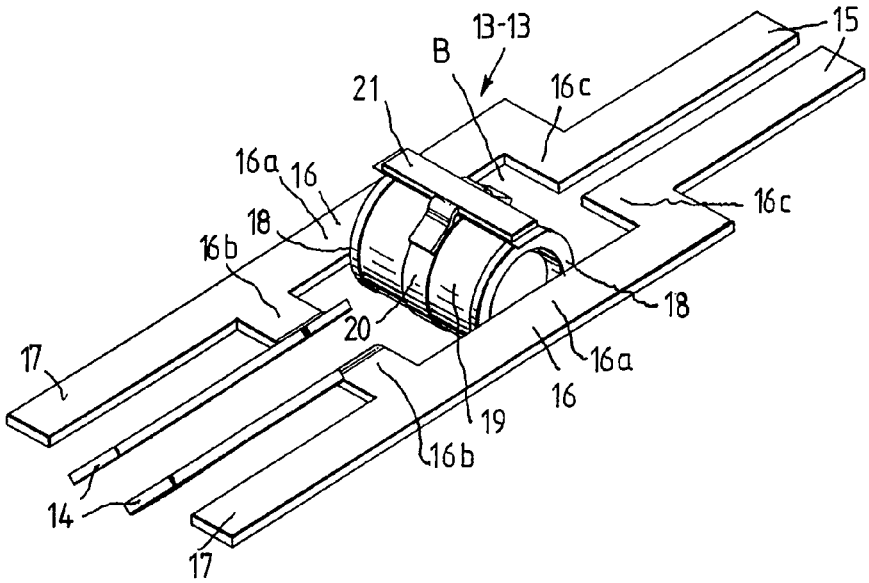
Figure 11:
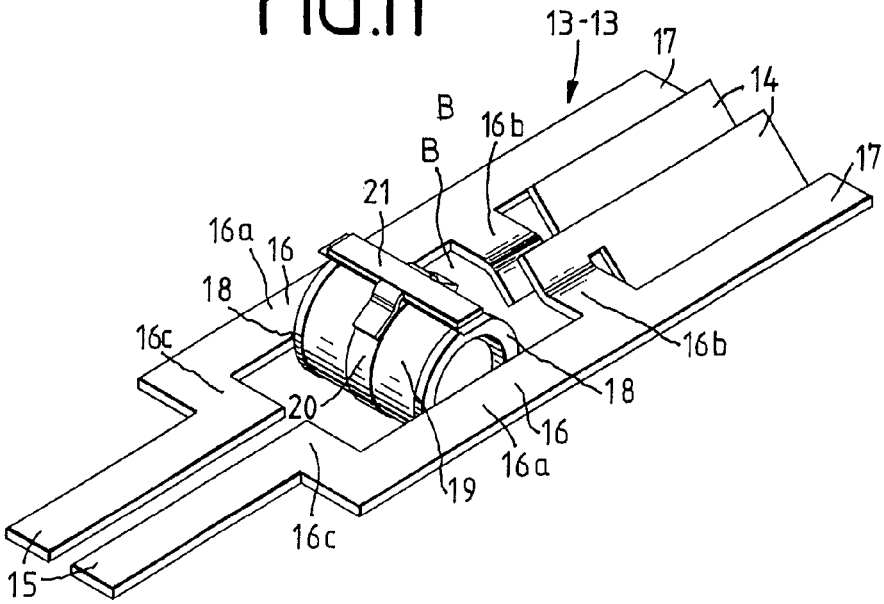
Figure 12:
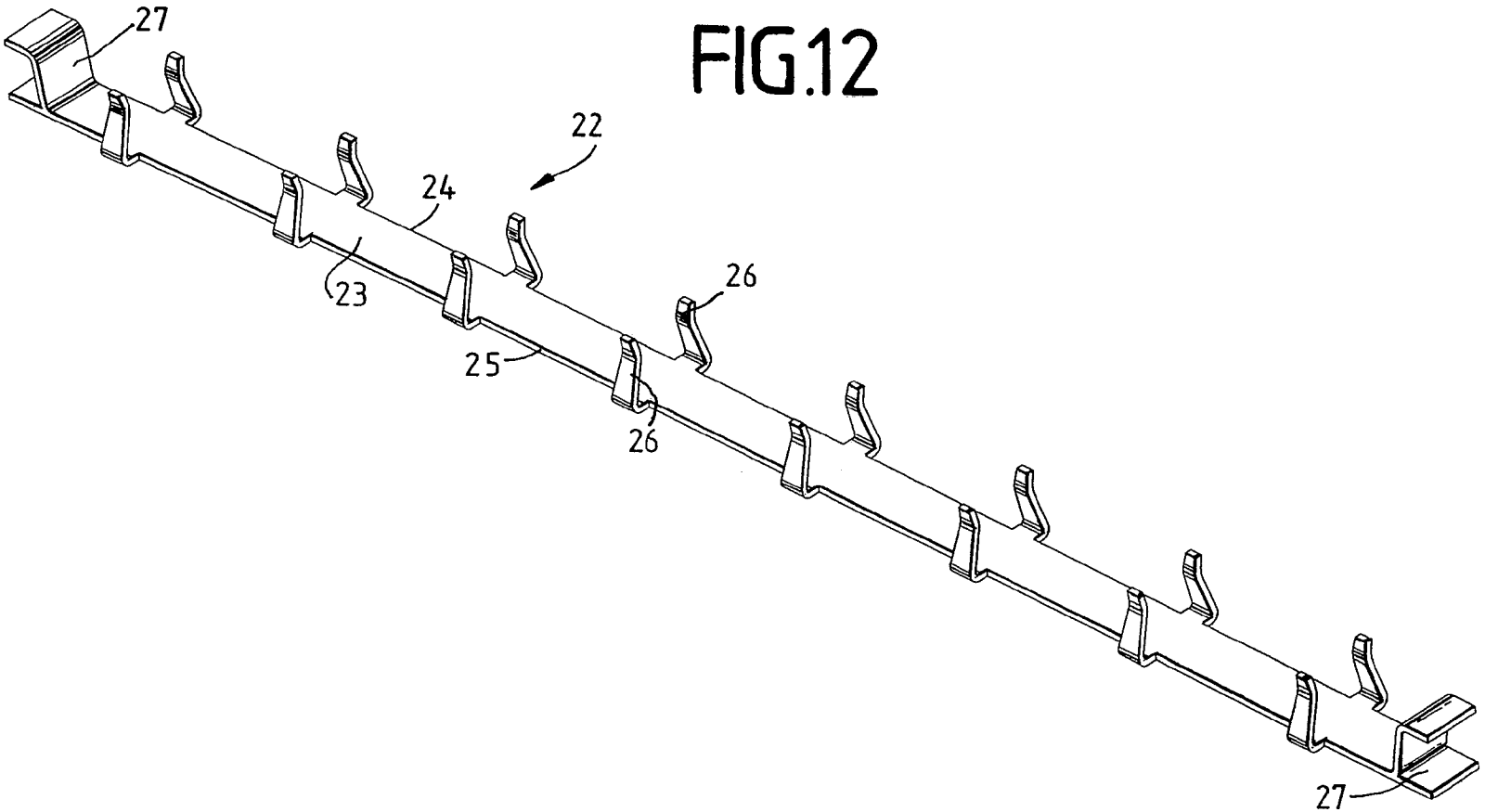
Figure 14:
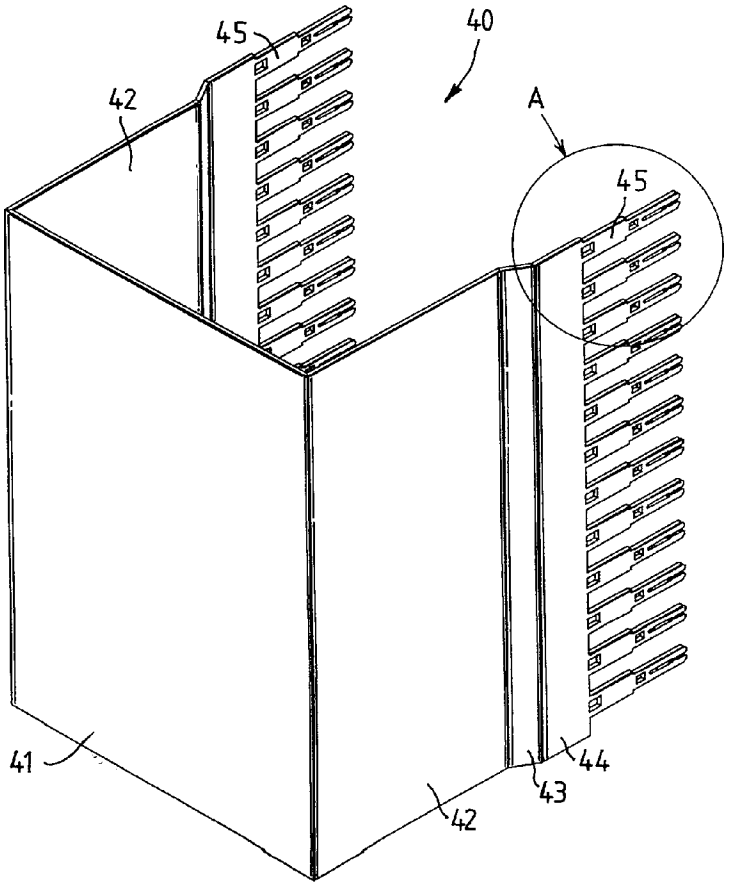
Figure 13:
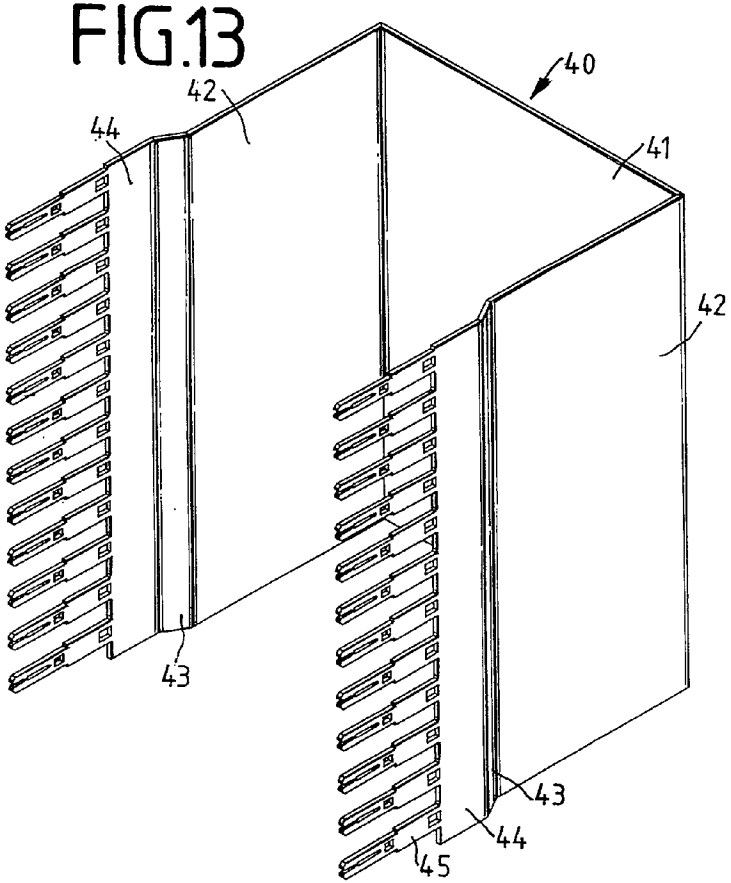
Figure 16:
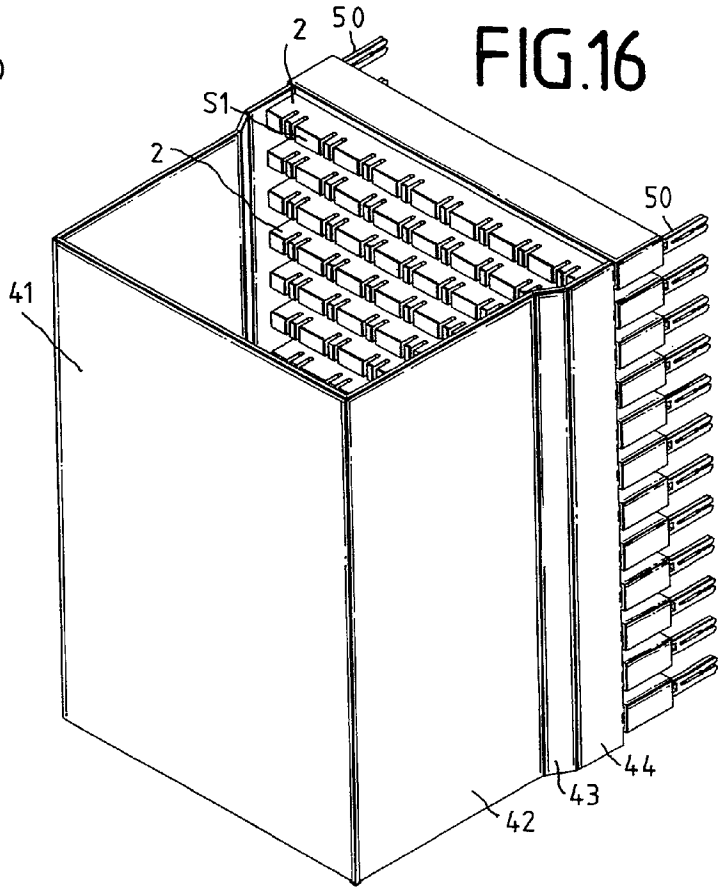
Figure 15:
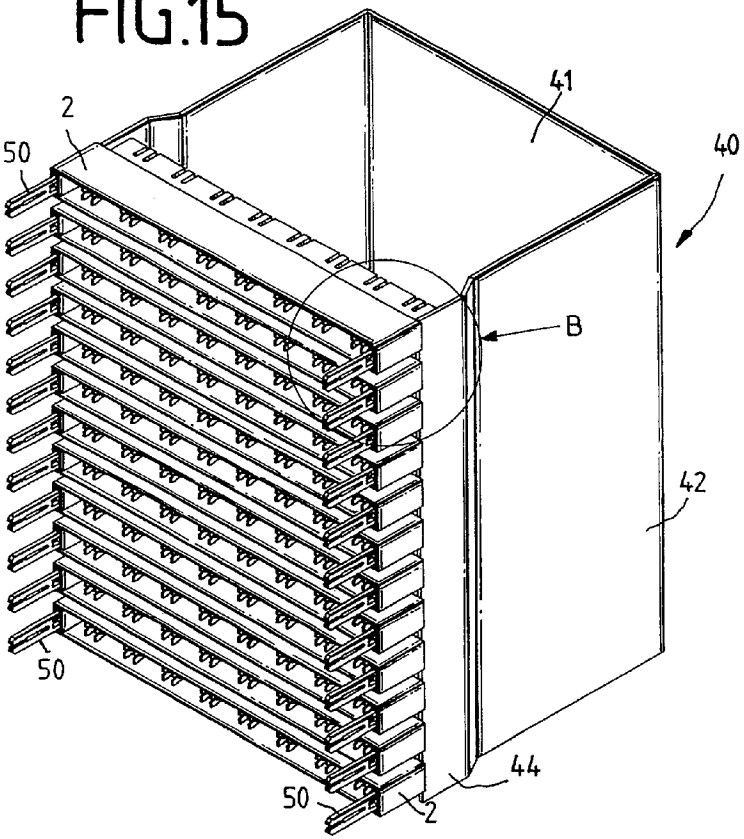
Figure 18:
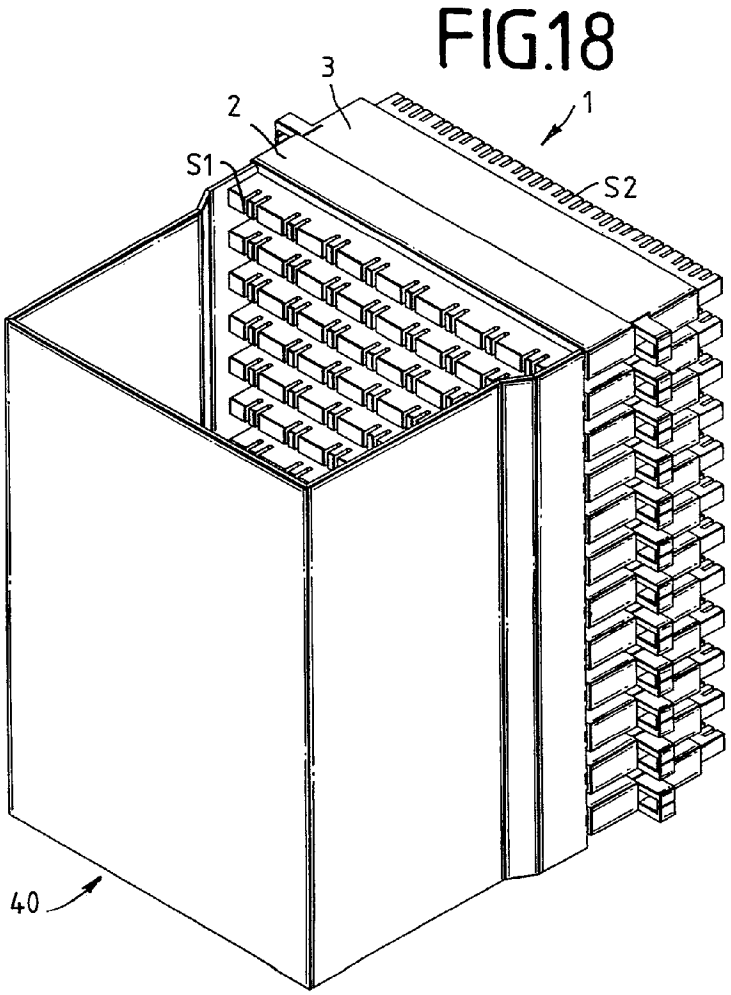
Figure 17:
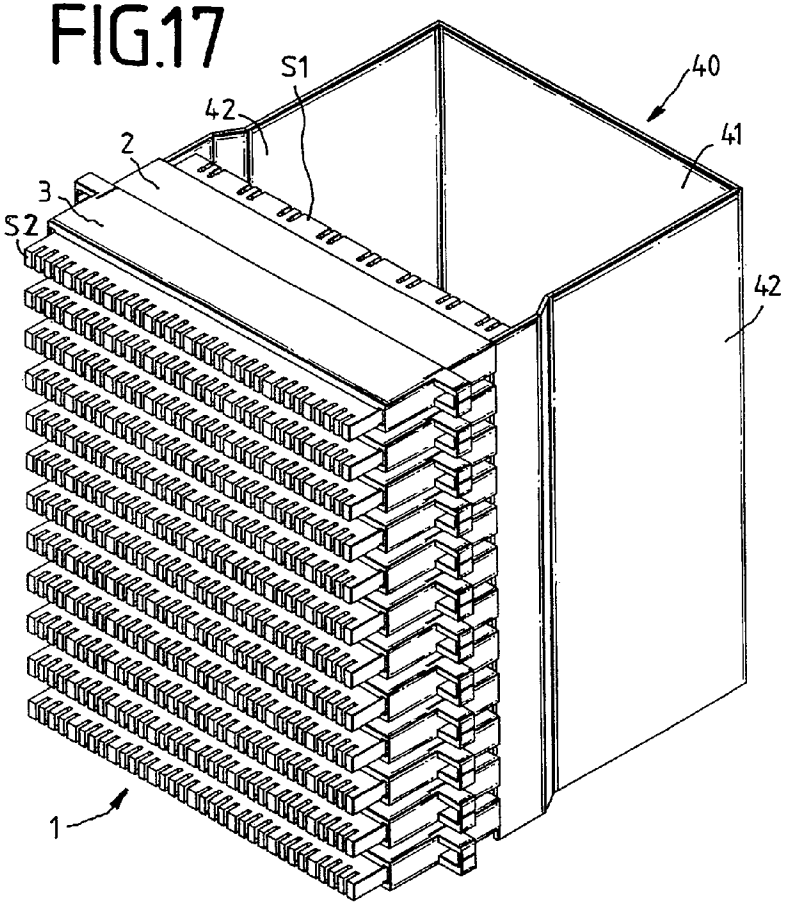
Figure 19:
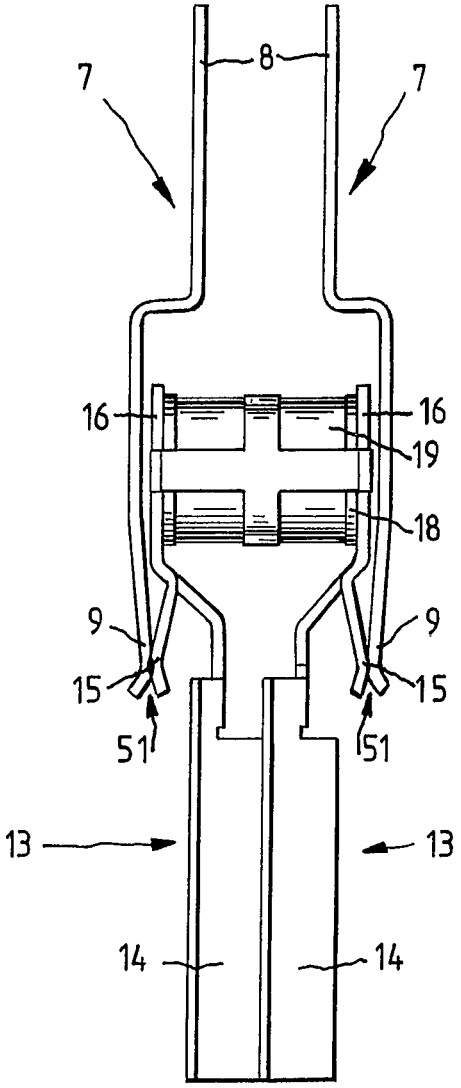
Figure 20:
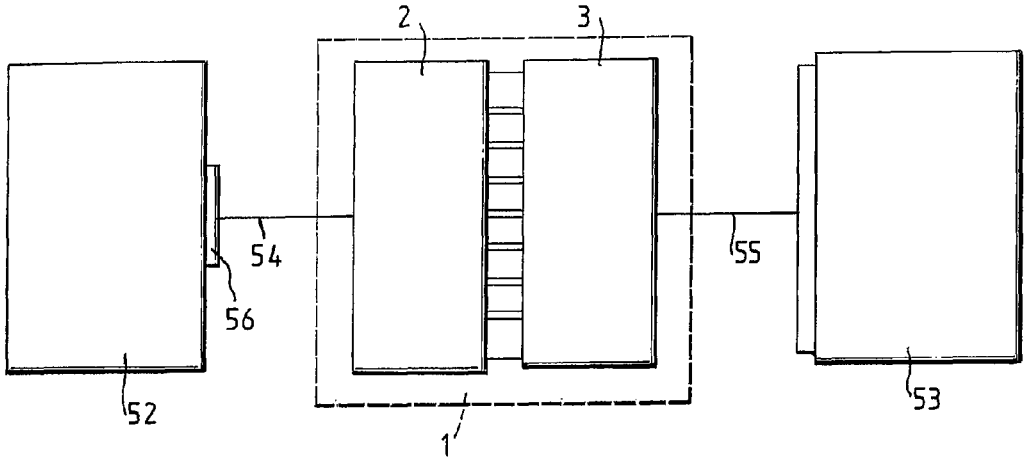
Figure 21:
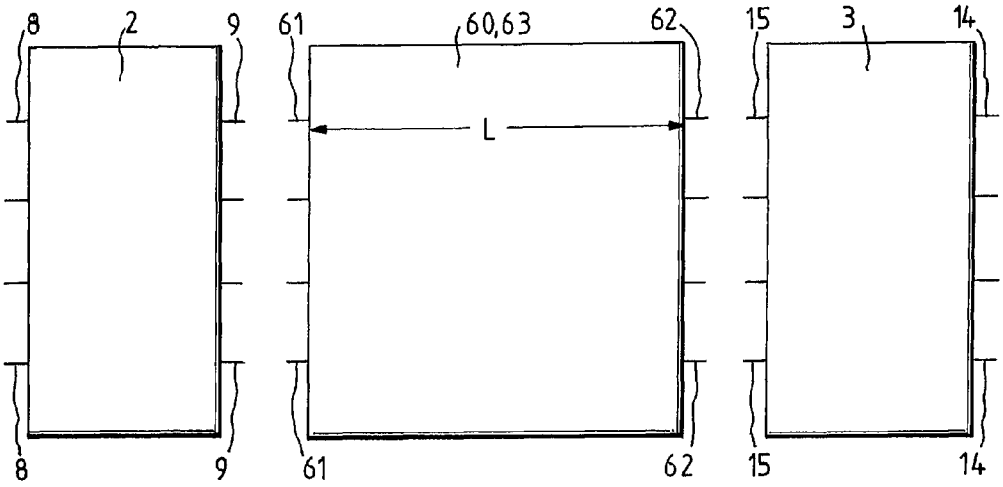

FIG. 8 shows a perspective front view of a contact element pair in a second submodule, FIG. 9 shows a perspective rear view of a contact element pair in a second submodule, FIG. 10 shows a perspective front view of an alternative embodiment of a contact element pair in a second submodule, FIG. 11 shows a perspective rear view of an alternative embodiment of a contact element pair in a second submodule, FIG. 12 shows a perspective illustration of a common ground, FIG. 13 shows a perspective front view of a mount system in the form of a trough, FIG. 14 shows a perspective rear view of a mount system in the form of a trough, FIG. 15 shows a perspective front view of the mount system with plugged-on first submodules, FIG. 16 shows a perspective rear view of the mount system with plugged-on first submodules, FIG. 17 shows a perspective front view of a mount system with plugged-on distribution connection modules, FIG. 18 shows a perspective rear view of the mount system with plugged-on distribution connection modules, FIG. 19 shows a schematic illustration of an embodiment with sprung contact limbs as interface contacts, FIG. 20 shows a schematic diagram of a telecommunications infrastructure with distribution connection modules according to the invention, and FIG. 21 shows a schematic illustration of a distribution connection module with three submodules.

Figures 1, 2:
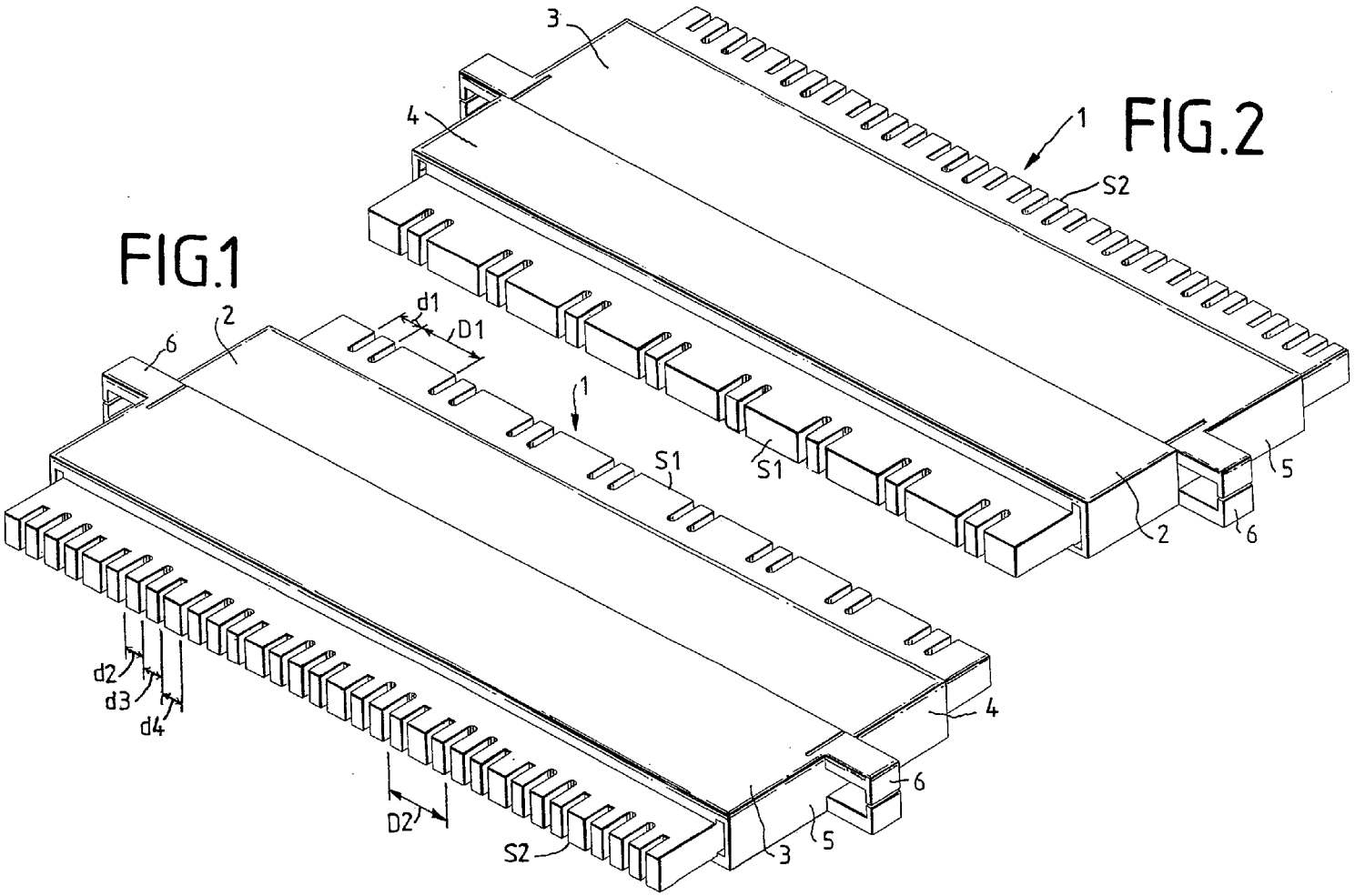
FIG. 1 shows a perspective front view of a distribution connection module.
FIG. 2 shows a perspective rear view of a distribution connection module.

FIGS. 1 and 2 show perspective illustrations of the distribution connection module 1 for telecommunications and data technology. The distribution connection module 1 comprises a first submodule 2 and a second submodule 3. In this case, an upper face of a housing 4 of the first submodule 2 forms a first end face S1, from which connecting contacts 8 (see FIGS. 3 to 5) in the first submodule 2 are accessible. In this case, the connecting contacts eight are insulation-displacement terminal contacts. The first submodule 2 has sixteen connecting contacts 8, thus allowing eight double conductors to be connected. The connecting contacts 8 are in this case associated in pairs, with the distance d1 between the connecting contacts 8 in an associated pair being many times less than the distance D1 between the connecting contacts 8 of different pairs. Correspondingly, an upper face of a housing 5 of the second submodule 3 forms a second end face S2, from which connecting contacts 14 (see FIGS. 8 to 11) in the second submodule 3 are accessible. The number of contacts which are accessible from the second end face S2 is twice as great as the number of connecting contacts in the first submodule 2. The contacts which are accessible from the end face S2 may all be connecting contacts, in particular insulation-displacement terminal contacts, or else only half of them may be. This will be explained in even more detail later with reference to FIGS. 8 to 11. In this case, d2 denotes the distance between the connecting contacts 14 (see FIGS. 8 to 11) of a contact element pair 13-13. The distance d2 is in this case preferably the same as the distance d1. The distance d3 in this case denotes the distance between a connecting contact 14 and an adjacent further connecting contact 17, with the connecting contact 14 and the further connecting contact 17 being connected to one another (see FIGS. 8 to 11). In this case, d2 is preferably equal to d3. The distance d4 denotes the distance between a further connecting contact 17 of a contact element pair 13-13 and an adjacent connecting contact 17 of an adjacent contact element pair 13-13, with d4 being greater than d3 or d2. The distance D2 denotes the distance between two adjacent connecting contacts 14 of different contact pairs, and is preferably the same as D1. Cable guides 6 are also arranged at the side on the second submodule 2.

Figure 3:
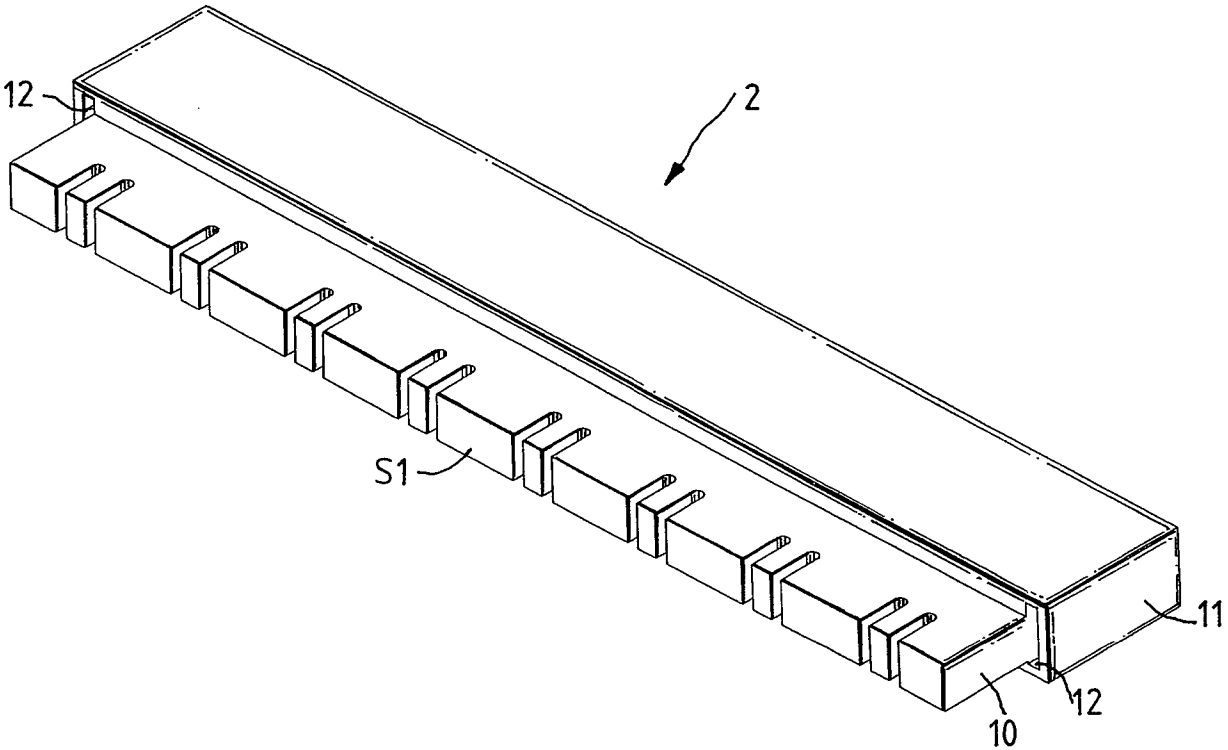
FIG. 3 shows a perspective front view of a first submodule.
Figure 4:
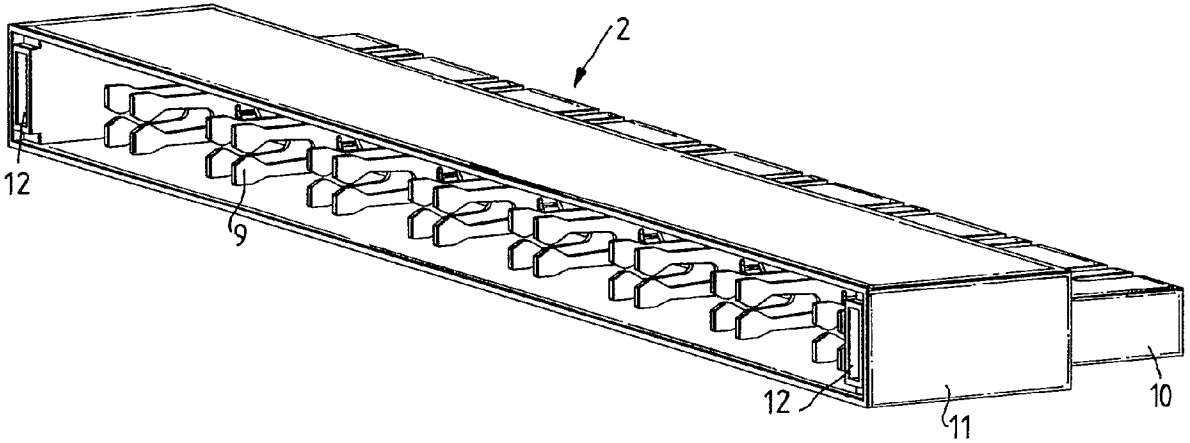
FIG. 4 shows a perspective rear view of a first submodule.
Figure 5:
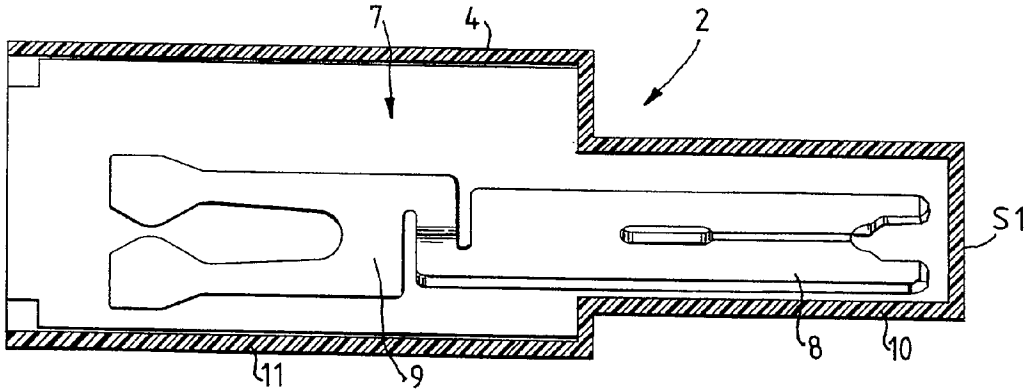
FIG. 5 shows a cross section through a first submodule.
Figures 6, 7:
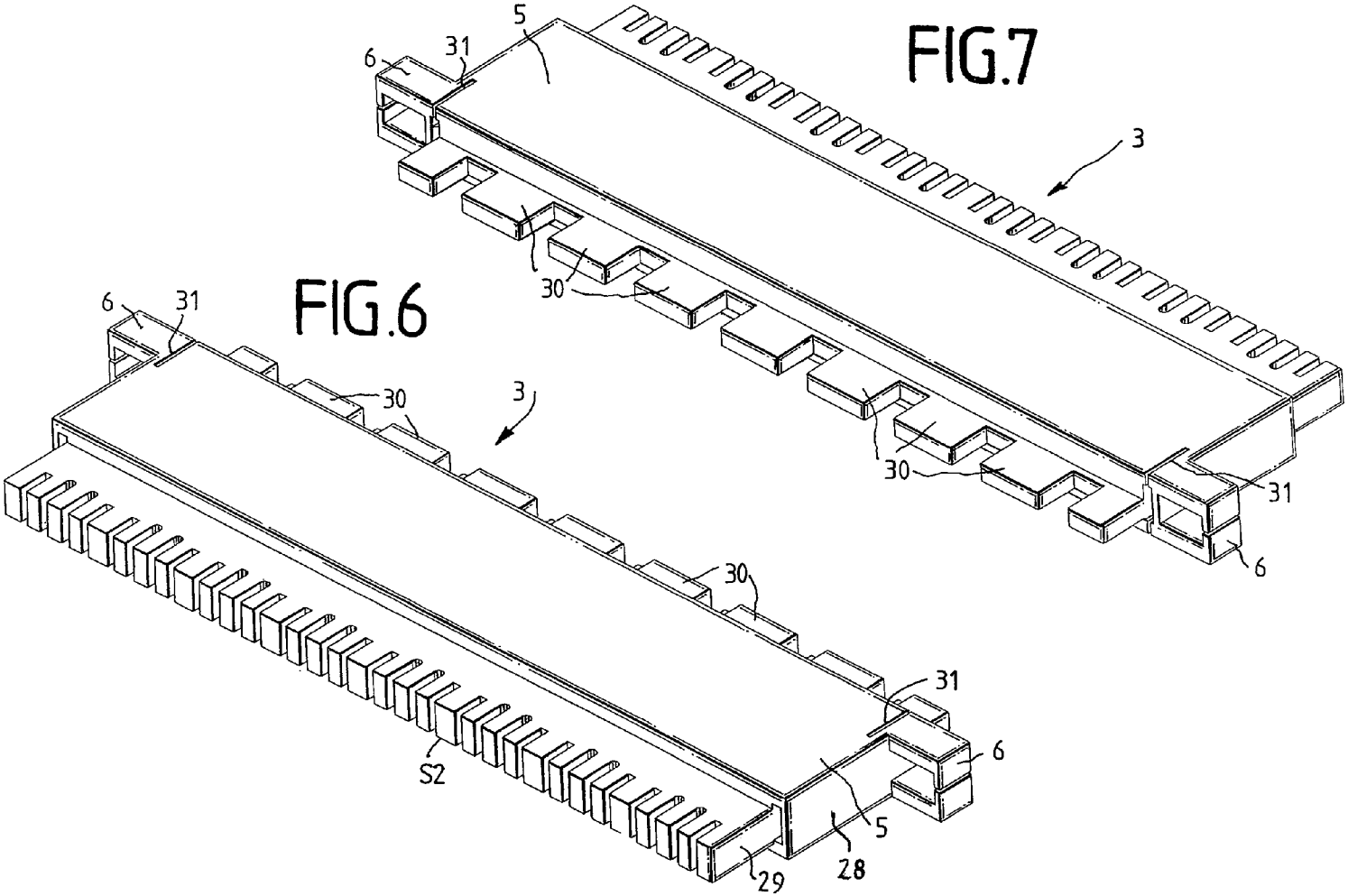
FIG. 6 shows a perspective front view of a second submodule.
FIG. 7 shows a perspective rear view of a second submodule.

First of all, the design of the first submodule 2 will be explained in more detail with reference to FIGS. 3 to 5. The first submodule 2 comprises sixteen contact elements 7, which are arranged in a captive manner in the housing 4. Each contact element 7 comprises a connecting contact 8 and an interface contact 9. The connecting contact 8 is preferably in the form of a conductor connecting contact, in particular an insulation-displacement terminal contact. In this case, the interface contact 9 is preferably a fork contact. However, the interface contact 9 may, for example, be a contact tongue. The only important factor is that the interface contact 9 is matched to a corresponding interface contact 15 on the second submodule 3. The contact element 7 is preferably an integral stamped and bent part. The housing 4 of the first submodule 2 is stepped and has a narrower upper part 10 and a broader lower part 11, with an insertion channel 12 in the form of a slot in each case being formed at the side at the junction, and extending over the entire lower part 11. The function of the insertion channel 12 will be explained in even more detail later.

First of all, the design of the second submodule 3 will be explained in more detail with reference to FIGS. 6 to 12. The second submodule 3 likewise has sixteen contact elements 13, with FIGS. 8 and 9, as well as 10 and 11, respectively showing two embodiments as contact element pairs 13-13. Each contact element 13 comprises a connecting contact 14, an interface contact 15, a function contact 16 and a further connecting contact 17. In this case, the connecting contacts 14 are in the form of insulation-displacement terminal contacts. In the embodiment shown in FIGS. 8 and 9, the further connecting contact 17 is a conductor connecting contact in the form of an insulation-displacement terminal contact. In this case, all four insulation-displacement terminal contacts are aligned parallel to one another, although this is not essential. In the exemplary embodiment shown in FIGS. 10 and 11, the connecting contact 17 is, in contrast, a contact tongue. In this case, the conductor connecting contact 14, which is in the form of an insulation-displacement terminal contact, and the contact tongue are at an angle of 45°. The further connecting contacts 17 can be used as a measurement point or else also for switching operation without any interruption, in particular in the embodiment where the further connecting contacts 17 are conductor connecting contacts, for example insulation-displacement terminal contacts.

In the embodiment shown in FIGS. 8 and 9, the first interface contact 15 is a fork contact, and in the embodiment shown in FIGS. 10 and 11, it is a contact tongue. The first interface contact 15 is in this case used for electrical connection to an interface contact 9 in the first submodule 2. In this case, in the embodiment where the first interface contacts 15 are fork contacts, the interface contacts 9 are contact tongues, or else are still fork contacts. The function contacts 16 are U-shaped. A base of the U-shaped contact forms a contact strip 16*a*, which is used for connection of the function element. In this case, one contact strip 16*a* in a contact element pair 13-13 is in each case connected to one electrode 18 of a three-pole surge arrester 19. One limb 16*b* of the U-shaped function contact 16 forms a connecting web between the contact strip 16*a* and a connecting contact 14 or a connecting contact 17. The other limb 16*c* forms a connecting rod between the contact strip 16*a* and the interface contact 15. As is illustrated in FIGS. 10 and 11, the U-shaped function contact 16 in this case lies on the same plane as the connecting contact 17 or interface contact 15, which is a contact tongue. The function contacts 16 of the contact element pair 13-13 are aligned with their limbs 16*b*, 16*c* with respect to one another such that a rectangular area B, in which the surge arrester 19 is arranged, is formed between the function contacts 16. A center electrode 20 of the surge arrester 19 represents the ground connection. A fail-safe contact 21 is arranged on said ground connection, and is associated with a melting element. In the event of an overvoltage, the melting element melts, and the fail-safe contact 21 then makes contact with the electrodes 18, as a result of which they are connected to ground.

A common ground 22, which is illustrated in FIG. 12, is used to make the ground connection from the center electrode 20 to a mount system. The common ground 22 comprises an elongated base rail 23, from whose upper edge 24 and lower edge 25 contacts 26 in each case originate, which clasp the surge arresters 19 from two sides, and in the process make contact with the center electrode 20. A ground contact 27 with a U-shaped cross section is arranged at each of the two ends of the base rail 23.

The contact element pairs 13-13 are first of all electrically connected, for example soldered, welded or adhesively bonded, to the surge arresters 19. However, in principle, it is also possible for the function contacts 16 to be designed differently, for example as fork or spring contacts. The common ground 22 is then connected to the surge arresters 19. These are then plugged together into the housing 5 of the second submodule 3. Alternatively, it is also possible for the common ground 22 to be plugged on retrospectively from the outside, with the contacts 26 extending through openings in the housing 5 and making contact with the center electrodes 20. In this case, the housing 5 may be formed from one or two parts. In a manner similar to the housing 3, the housing 5 comprises a broader lower part 28 and a narrower upper part 29. Cuboid guides 30, between which the interface contacts 15 are located, are arranged on the lower part 28. Furthermore, the housing 5 has insertion channels 31 at the side.

FIGS. 13 and 14 show a mount system 40 in the form of a trough. The mount system 40 has an essentially U-shaped form. The mount system 40 for this purpose has a rear wall 41 and two side walls 42. On each of the end surfaces facing away from the rear wall 41, the side walls 42 have a step 43, which is directed outward, with an extension 44 adjacent thereto, with the extension 44 being parallel to the side wall 42. Holding elements 45 are arranged on the end faces of the extension 44. The holding elements 45 each have a broad web 46 and a narrow web 47, which respectively have a latching holder 48 and 49. On the end face, the narrow web 47 is in the form of a fork contact 50.

The fitting of the distribution connection module 1 to the mount system 40 will now be explained in more detail with reference to FIGS. 13 to 18. In a first step, the first submodules 2 are connected to conductors. The connected first submodules 2 are then plugged onto the holding elements 45 via the insertion channels 12, with the end face S1 of the respective first submodule 2 facing the rear wall 41. In the process, latching elements within the insertion channels 12 latch into the latching holder 48 in the respective holding element 45. The narrow web 47 with its latching holder 49 and the fork contact 50 in this case projects out of the first submodule 2. This is illustrated in FIGS. 15 and 16, although the connected conductors are not shown, for clarity reasons. The completely or partially fitted mount system can thus, for example, be fitted as a prefabricated module, with conductors connected on one system side.

Finally, FIGS. 17 and 18 show the final state. For this purpose, the insertion channels 31 in the second submodules 3 were plugged onto the projecting narrow webs 47 (see FIG. 13). In the process, the second submodule 3 engages with latching holders 49, by means of latching elements within the insertion channels 31, with the fork contacts 50 making contact with the ground contacts 27 on the common ground 22. In this case, it should be noted that the second submodules can be connected before or after plugging onto the webs 47. Furthermore, the plugging-in process leads to a connection between the interface contacts 15 in the second submodule 3 and the interface contacts 9 in the first submodule 2, as a result of which the conductor connecting contacts 8 are connected to the conductor connecting contacts 14.

It should also be noted that the latching holder 49 is smaller than the latching holder 48. The latching force of the second submodule 3 is therefore somewhat less, thus allowing it to easily be unlatched by bending on the cable guides 6, for example in order to replace submodules 3 with defective surge arresters 19.

FIG. 19 schematically illustrates an embodiment where the interface contacts 9, 15 are in the form of sprung contact limbs which form a disconnecting contact 51. The housing parts are not shown, for clarity reasons. The contact elements 7 of the first submodule 2 each have a connecting contact 8 and an interface contact 9. The contact elements 13 in the second submodule 3 each have a connecting contact 14, a function contact 16 and an interface contact 15. A surge arrester 19 is electrically connected to the function contacts 16, for example by being welded by means of a laser. In this case, the function contact 16 runs from the connecting contact 14 to the electrodes 18. The interface contact 15 then branches off from the function contact 16, is fed back in the direction of the connecting contact 14, and, with the interface contact 9, forms a disconnecting contact 51. The disconnecting contact 51 is then accessible from the end face S2 of the second submodule 3.

FIG. 20 schematically illustrates a block diagram of a telecommunications infrastructure. The distribution connection modules 1 according to the invention are illustrated centrally. The first submodules 2 are connected to a system 52, for example an MSAN (Multi Service Access Node). The second submodules are connected to a subscriber system 53, which may in general also be referred to as CTTX (Copper to the X). In this case, the subscriber system 53 may, for example, also be a cable splitter. The connection between the system 52 and the first submodules 2 is preferably made via prefabricated cables 54. Correspondingly, the connection between the second submodules 3 and the subscriber system 53 is preferably made via the prefabricated cables 55.

The connection face of the first submodule 2 is preferably always the same, with the connecting contacts 8 preferably being in the form of insulation-displacement terminal contacts. In this case, the cables 54 may have different system plugs 56, depending on the application. The first submodule 2 is therefore preferably matched to different systems 52 exclusively via the choice of the system plugs 56 on the prefabricated cable 53. An appropriate second submodule 3 may be used, depending on the application. This may then be formed with connecting contacts 14 which are optimized for the respective application, for example with coaxial plug connectors, RJ plug connectors, insulation-displacement terminal contacts, double insulation-displacement terminal contacts (see FIGS. 8, 9), insulation-displacement terminal contacts with a measurement tap (see FIGS. 10, 11), or insulation-displacement terminal contacts with disconnecting contacts (see FIG. 19). Widely differing infrastructures can therefore be formed or converted by means of the distribution connection modules 1 according to the invention, for example by replacement of the second submodules 3. In particular, the modular design of the distribution connection module 1 allows flexible and rapid construction.

FIG. 21 schematically illustrates a distribution connection module 1 having a first submodule 2, a second submodule 3 and a third submodule 60, which is arranged between the first submodule 2 and the second submodule 3. The third submodule 60 comprises interface contacts 61 for connection to the interface contacts 9 in the first submodule 2 and interface contacts 62 for connection to the interface contacts 15 in the second submodule 3. In this case, by way of example, a printed circuit board with electrical components is arranged in the third submodule 60. In this case, the interface contacts 61, 62 are matched to the interface contacts 9, 15 in the first and second submodules 2, 3. For example, if the interface contacts 9 are fork contacts and the interface contacts 15 are contact tongues, then the interface contacts 61 are, for example, contact pads on the printed circuit board or contact tongues of a contact element, while in contrast the interface contacts 62 are fork contacts. The length L of the housing 63 of the third submodule 60 may in this case be of a different size, depending on the type of components that are intended to be accommodated. If there are more than three submodules, the statements apply in the same sense, in which case the submodules between the first and second submodules can be figuratively combined to form a third submodule.

LIST OF REFERENCE SYMBOLS

1 Distribution connection module
2 First submodule
3 Second submodule
4 Housing
5 Housing
6 Cable guide
7 Contact element
8 Connecting contact

9 Interface contact
10 Upper part
11 Lower part
12 Insertion channel
13 Contact element
13-13 Contact element pair
14 Connecting contact
15 Interface contact
16 Function contact
16*a* Contact strip
16*b* Limb
16*c* Limb
17 Connecting contact
18 Electrode
19 Surge arrester
20 Center electrode
21 Fail-safe contact
22 Common ground
23 Base rail
24 Upper edge
25 Lower edge
26 Contact
27 U-shaped ground contact
28 Lower part
29 Upper part
30 Cuboid guide
31 Insertion channel
40 Mount system
41 Rear wall
42 Side wall
43 Step
44 Extension
45 Holding element
46 Broad web
47 Narrow web
48 Latching holder
49 Latching holder
50 Fork contact
51 Disconnecting contact
52 System
53 Subscriber system
54 Cable
55 Cable
56 System plug
60 Third submodule
61 Interface contact
62 Interface contact
63 Housing
S1 First end face
S2 Second end face
d1 Distance between the connecting contacts of a contact pair in the first submodule
D1 Distance between connecting contacts of adjacent contact pairs in the first submodule
d2 Distance between connecting contacts of a contact pair in the second submodule
d3 Distance between a connecting contact and a further connecting contact of a contact element in the second submodule
d4 Distance between further connecting contacts of adjacent contact pairs in the second submodule
D2 Distance between connecting contacts of adjacent contact pairs in the second submodule
B Rectangular area
L Length

The invention claimed is:

1. A distribution connection module for telecommunications and data technology, with the distribution connection module comprising:

a first submodule having a plurality of first contact elements, the first contact elements each having an electrical connecting contact and an interface contact; and a second submodule having second contact elements, the second contact elements each having an electrical connecting contact and an interface contact;

the interface contacts of the first submodule being configured to be electrically connected to the interface contacts of the second submodule when engaged together;

the second contact elements also including function contacts disposed between the electrical connecting contacts and the interface contacts, each of the second contact elements being associated with another of the second contact elements to form a contact element pair; and a plurality of function elements, each function element being disposed between the second contact elements of a respective one of the contact element pairs.

2. The distribution connection module as claimed in claim 1, wherein the first submodule includes a first housing and the second submodule includes a second housing.

3. The distribution connection module as claimed in claim 1, wherein the first and second contact elements of the first submodule and the second submodule are arranged in a captive manner.

4. The distribution connection module as claim 1, wherein the interface contacts of the first and second submodule are in the form of fork contacts or contact tongues.

5. The distribution connection module as claimed in claim 1, wherein the interface contacts of the first contact elements in the first submodule are in the form of sprung contact arms, wherein one interface contact of the first contact elements forms a disconnecting contact.

6. The distribution connection module as claimed in claim 1, wherein the function contacts have rectangular contact strips to which the function elements are connected.

7. The distribution connection module as claimed in claim 6, wherein the function contacts are U-shaped, with a base of the U-shaped contact forming the contact strip, and with limbs of the U-shaped contact forming connecting webs for the connecting contact and the interface contact of the second contact element.

8. The distribution connection module as claimed in claim 7, wherein the function contacts of each contact element pair are aligned with the limbs with respect to one another, such that a rectangular area, in which the function element is arranged, is formed between the function contacts.

9. The distribution connection module as claimed in claim 1, wherein the function elements are in the form of surge arresters.

10. The distribution connection module as claimed in claim 9, wherein ground connections of the surge arresters are connected to a common ground.

11. The distribution connection module as claimed in claim 1, wherein the second contact elements of the second submodule each have a further connecting contact.

12. A method for connection of at least one distribution connection module as claimed in claim 1, comprising:

a) terminating conductors at the connecting contacts of the at least one first submodule, b) attaching the at least one first submodule to a mount system, and c) connecting the at least one second submodule to the first submodule.

13. The distribution connection module as claimed in claim 1, further comprising a further submodule having a first row of interface contacts and a second row of interface contacts, wherein the first row of interface contacts of the further submodule are configured to electrically connect to the interface contacts of the first submodule, and wherein the second row of interface contacts of the further submodule are configured to electrically connect to the interface contacts of the second submodule.

14. The distribution connection module as claimed in claim 1, wherein the interface contacts of the second contact elements in the second submodule are in the form of sprung contact arms, wherein one interface contact of the second contact elements forms a disconnecting contact.

15. The distribution connection module as claimed in claim 1, wherein each functional element has a center electrode that functions as a ground connection and a fail-safe contact arranged on the ground connection, the fail-safe contact being associated with a melting element.

16. The distribution connection module as claimed in claim 15, wherein each of the second contact elements includes a further connecting contact.

17. The distribution connection module as claimed in claim 15, wherein the interface contacts of the second contact elements are fork contacts and the connection contacts of the second contact elements are insulation displacement contacts.

18. The method of claim 12, wherein attaching the at least one first submodule to a mount system comprises inserting holding elements of the mount system through insertion channels defined in the first submodule until latching elements within the insertion channels latch into first latching holders in the holding elements.

19. The method of claim 18, wherein connecting the at least one second submodule to the first submodule comprises inserting distal ends of the holding elements through insertion channels defined in the second submodule until latching elements within the insertion channels of the second submodule latch into second latching holders in the holding elements, the second latching holders being smaller than the first latching holders.

20. A method for connection of at least one distribution connection module as claimed in claim 1, comprising:

a) terminating conductors at the connecting contacts of the at least one first submodule, b) attaching the at least one first submodule to a mount system, c) connection of at least one further submodule to the first submodule; and d) connecting the at least one second submodule to the at least one further submodule.

* * * * *